US005364021A

United States Patent [19]

Munk

[11] Patent Number: 5,364,021

[45] Date of Patent: Nov. 15, 1994

[54] MAILING PACK

[75] Inventor: Marvin R. Munk, New City, N.Y.

[73] Assignee: Amdurables, Inc., Saddle Brook, N.J.

[21] Appl. No.: 110,387

[22] Filed: Aug. 23, 1993

[51] Int. Cl.[5] ..... B65D 5/20; B65D 65/22

[52] U.S. Cl. ..... 229/157; 206/806; 229/92.8; 229/156; 229/158; 229/921

[58] Field of Search ..... 229/40, 92.8, 101, 156, 229/157, 158, 921; 206/806

[56] References Cited

U.S. PATENT DOCUMENTS

| | | | |
|---|---|---|---|
| 292,863 | 2/1884 | Schmidt | 229/157 |
| 649,768 | 5/1900 | Sherriff | 229/158 |
| 923,111 | 5/1909 | Boberg | 229/921 |
| 955,880 | 4/1910 | Jager | 206/806 |
| 964,556 | 7/1910 | Rogers | 229/40 |
| 1,125,535 | 1/1915 | Hoffman | 229/101 |
| 1,707,680 | 4/1929 | Norwood | 229/157 |
| 1,806,149 | 5/1931 | Daugherty | 206/806 |
| 2,011,703 | 8/1935 | Barker . | |
| 2,840,294 | 6/1958 | Davis . | |
| 3,114,492 | 12/1963 | Engstrom | 229/101 |
| 3,219,256 | 11/1965 | Zastrow | 229/40 |
| 4,046,311 | 9/1977 | Voytko . | |
| 4,535,929 | 8/1985 | Sherman, II et al. | 229/921 |
| 4,953,779 | 9/1990 | Densen . | |

*Primary Examiner*—Gary E. Elkins

*Attorney, Agent, or Firm*—Richard M. Goldberg

[57] ABSTRACT

A mailing pack includes a bottom panel and first and second side flaps hingedly connected with first and second opposite edges of the bottom panel. First and second end flaps are hingedly connected with third and fourth opposite edges of the bottom panel. The first end flap extends in a first direction from the hinge edge thereof and the second end flap extends from the hinge edge thereof in an opposite direction. The bottom panel, first and second side flaps and first and second end flaps are constructed from a fluted material having flutes extending in a second direction. A securing tab arrangement secures the end flaps in substantially parallel covering relation to the side flaps and the bottom panel. The securing tab arrangement includes first and second slits in each side flap, first and second tabs hingedly connected with the first end flap for slidable engagement within the first slits of the side flaps, and third and fourth tabs hingedly connected with the second end flap for slidable engagement within the second slits of the side flaps. The tabs are cut-out from the end flaps at positions spaced inwardly from edges thereof, and extend substantially in the second direction of the flutes. The first and second tabs extend in a direction different from the first direction of the first end flap, and the third and fourth tabs extend in a direction different from the opposite direction of the second end flap.

21 Claims, 8 Drawing Sheets

MAILING PACK

BACKGROUND OF THE INVENTION

The present invention relates generally to mailing packs, and more particularly, is directed to a mailing pack with a secure tab closure arrangement.

While attending trade shows and the like, a person often collects large amounts of literature from the different booths. This literature is carried in a bag, attache case, suitcase or the like. This, however, becomes rather bulky, and also adds much weight to the bag, attache case, suitcase or the like during travel.

If the person desires to mail the literature back to his home office, in order to reduce the weight during travel, the person must first find a mailing envelope or mailing box. Even when this is accomplished, separate sealing means in the form of adhesive, tape, staples or the like must be used to seal the mailing envelope or mailing box. Also, the literature tends to slide around in such mailing envelope or mailing box, and may become disorganized.

Although various mailing packs are known which use locking tabs, these containers orient the tabs in the same direction as the folding direction of the flaps to which they are connected. Since there would be a tendency for the tabs to escape, the tabs are provided with locking ears at opposite ends thereof to prevent such escape.

The combined width of the tabs and locking ears are longer than the slots which receive the tabs. As a result, when a tab enters a slot, the ears bend inwardly, and after the tab is in the slot, the ears bend outwardly to retain the tab in the slot, by engaging behind the outer edges of the slot. Although this provides a relatively secure arrangement for mailing, the use of locking ears on the tabs adds complexity to the tabs, makes it more difficult to assemble the mailing pack, and makes opening of the mailing pack at the delivery end difficult.

Further, such tabs are only provided at various fold lines of the mailing pack so as to be unobtrusive. As a result, the tabs are positioned away from the contents of the mailing pack, and do not interact therewith. Specifically, the tabs are formed as extensions of the free edges of the folding panels of the mailing pack.

In addition, because of the locking ears, it is difficult to make a shallow mailing pack.

OBJECTS AND SUMMARY OF THE INVENTION

Accordingly, it is an object of the present invention to provide a mailing pack that overcomes the problems with the aforementioned prior art.

It is another object of the present invention to provide a mailing pack that can be securely sealed by a thumb tab arrangement.

It is still another object of the present invention to provide a mailing pack in which the tab arrangement includes thumb tabs which are oriented transversely to the folding direction of the flaps on which they are arranged.

It is yet another object of the present invention to provide a mailing pack in which the thumb tab arrangement also inhibits movement of materials in the mailing pack.

It is a further object of the present invention to provide a mailing pack having a further interlocking tab locking arrangement.

It is a further object of the present invention to provide a mailing pack that is extremely durable for mailing.

In accordance with the present invention, a mailing pack includes a bottom panel; first and second side flaps hingedly connected with first and second opposite edges of the bottom panel; first and second end flaps hingedly connected with third and fourth opposite edges of the bottom panel, between the first and second opposite edges, a lengthwise direction of the mailing pack being defined as extending between the first and second end flaps, and the first and second end flaps being foldable in the lengthwise direction; and a securing tab assembly for securing the first and second end flaps in substantially parallel covering relation to the first and second side flaps and the bottom panel, the securing tab assembly including at least one slit in either the side flaps or the second end flap, and thumb tabs hingedly connected with the first end flap for slidable engagement within the at least one slit, the thumb tabs extending and being foldable in a direction having a large component perpendicular to the lengthwise direction.

In a first embodiment, there are two thumb tabs on the first end flap which substantially face each other. Each thumb tab includes a long edge hingedly connected with the first end flap, an opposite free shorter edge and side edges which connect the long edge and the shorter edge, and each thumb tab extending in a direction having a large component perpendicular to the lengthwise direction. Each thumb tab is cut-out from the first end flap, with the long edge thereof hingedly remaining connected with the first end flap.

Further, there is at least one slit formed in the first side flap and at least one slit formed in the second side flap. Preferably, there are two slits in each side flap, the slit-like openings in the first side flap being substantially parallel to each other and spaced apart in the lengthwise direction and the slit-like openings in the second side flap being substantially parallel to each other and spaced apart in the lengthwise direction.

In addition, in the first embodiment, there is tab means hingedly connected with the second end flap for slidable engagement within the at least one slit, the tab means extending in a direction having a large component perpendicular to the lengthwise direction. Preferably, the tab means on the second end flap includes two thumb tabs which substantially face each other. Specifically, each thumb tab is connected with the second end flap, and includes a long edge hingedly connected with the second end flap, an opposite free shorter edge and side edges which connect the long edge and the shorter edge, and each tab extending in a direction having a large component perpendicular to the lengthwise direction.

The mailing pack further includes a first side wall hingedly connected between and to the first side flap and the bottom panel; a second side wall hingedly connected between and to the second side flap and the bottom panel; a first end wall hingedly connected between and to the first end flap and the bottom panel; and a second end wall hingedly connected between and to the second end flap and the bottom panel.

In addition, the first and second end flaps each include an outer free edge, and it is preferable that a cut-out section is formed in the first or second end flap, the cut-out section extending inwardly from the outer free edge of the respective end flap, and an interlocking tab for lockingly engaging within the cut-out section extends from the outer free edge of the other end flap, the interlocking tab having substantially identical dimensions and shape to the cut-out section for engaging therein when the first and second end flaps are folded over and are substantially parallel to the bottom panel. In one embodiment, the interlocking tab has the shape of a simple quadrilateral.

Preferably, the bottom panel, the first and second side flaps and the first and second end flaps are constructed from a corrugated fluted plastic material, which is extremely durable for mailing, and is effectively tear-proof, water-repellent, washable and fire retardant.

In the second and third embodiments, the at least one slit includes first and second slits formed in the second end flap. In such case, the first and second slits are oriented at substantially equal and opposite angles relative to the lengthwise direction.

In the third embodiment, a slits is formed in each of the side flaps for receiving at least one free corner of the second end flap.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
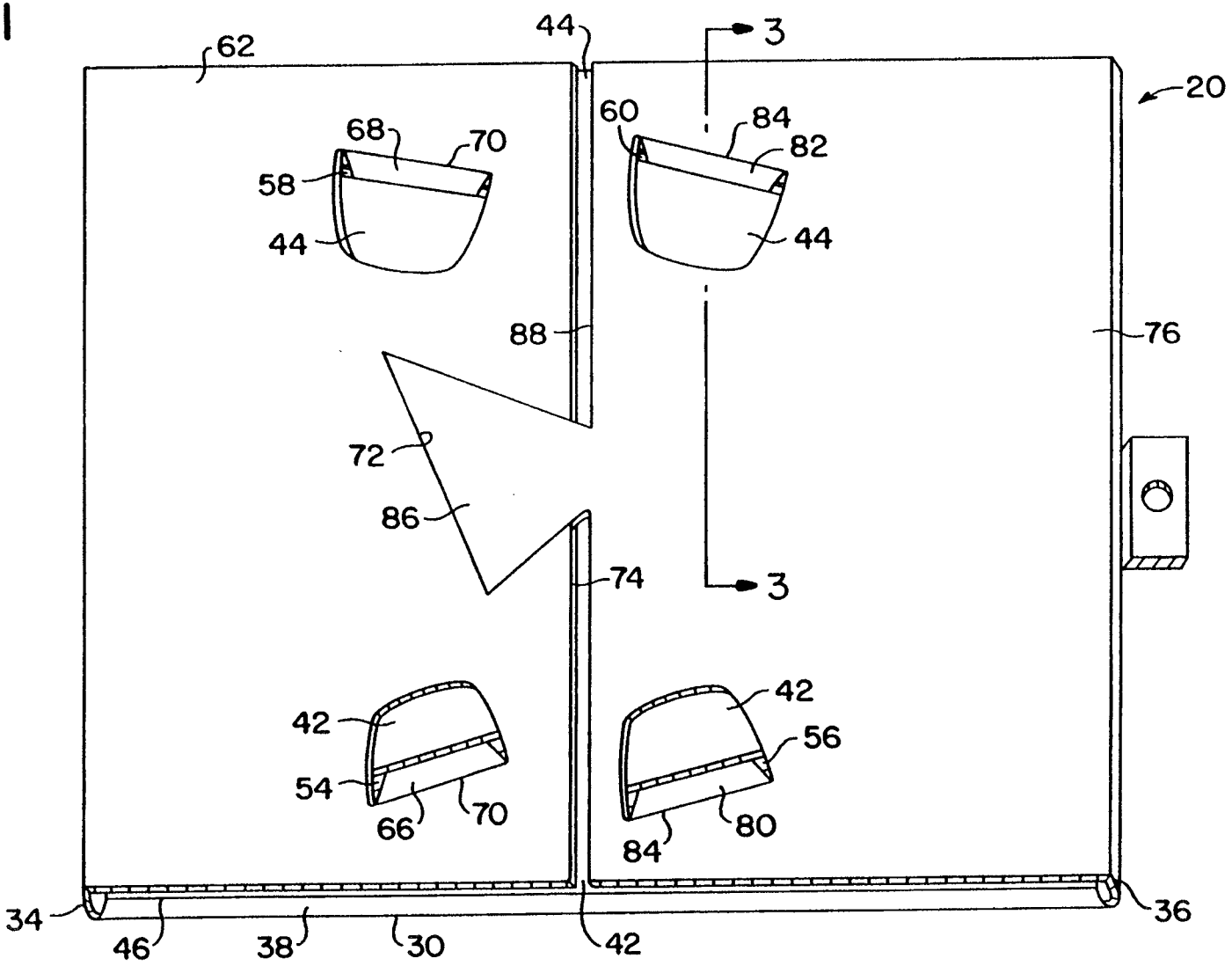
FIG. 1 is a perspective view of a mailing pack according to one embodiment of the present invention.
Figure 2:
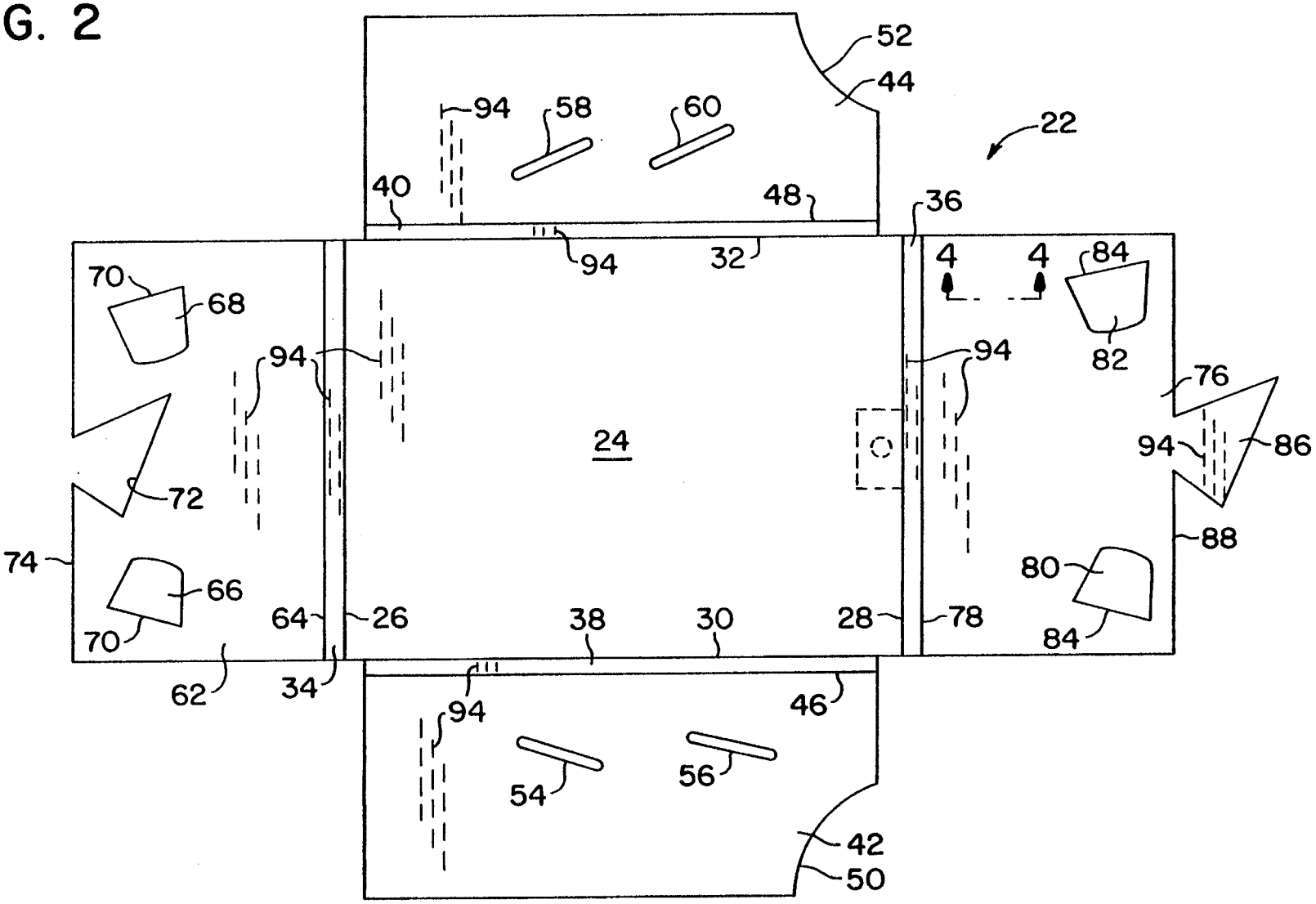
FIG. 2 is a plan view of a blank for forming the mailing pack of FIG. 1.

Referring to the drawings in detail, and initially to FIGS. 1–4 thereof, a mailing pack 20 according to a first embodiment of the present invention, which is in the form of a mailing envelope, is formed from the blank 22 shown in FIG. 2.

Specifically, and referring to FIG. 2, blank 22 includes a center panel 24 of a substantially rectangular configuration. Center panel 24 functions as a bottom wall of mailing pack 20 of FIG. 1. For example, center panel 24 can have dimensions slightly larger than 8½ inches by 11 inches in order to hold a stack of 8½ by 11 inch paper, although the present invention is not limited thereby. Center panel 24 therefore has four edges 26, 28, 30 and 32, with side edges 26 and 28 corresponding to the shorter sides.

Elongated rectangular side panels 34, 36, 38 and 40 are hingedly connected along edges 26, 28, 30 and 32 and can be bent upwardly to form side walls of mailing pack 20. In this regard, edges 26, 28, 30 and 32 form fold lines along which side panels 34, 36, 38 and 40 are folded upwardly so as to be substantially perpendicular to center panel 24 in the configuration for mailing which is shown in FIG. 1. The height of the side walls will depend on the width of side panels 34, 36, 38 and 40.

Figure 2A:
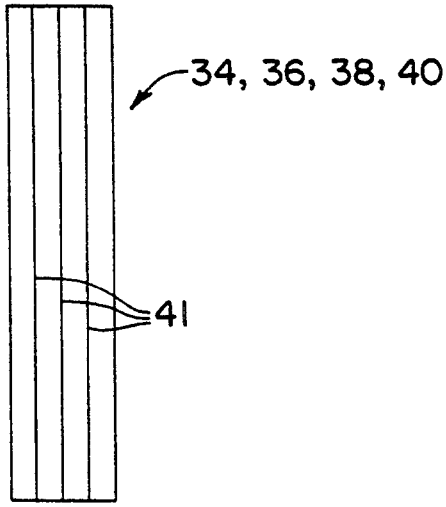
FIG. 2A is a plan view of a modified embodiment of a side panel of the mailing pack of FIG. 1.

Alternatively, side panels 34, 36, 38 and 40 can have a large width extending in the lengthwise direction of the mailing envelope, as shown in FIG. 2A, with each side panel 34, 36, 38 and 40 having a plurality of score lines 41 extending in the lengthwise direction thereof, that is, extending in the transverse direction of mailing envelope 20. In this manner, the height of mailing envelope 20 can be varied by selectively folding side panels 34, 36, 38 and 40 along one or more score lines 41.

Side flaps 42 and 44 are hingedly connected to the longer edges 46 and 48 of longer side panels 38 and 40, opposite to edges 30 and 32, respectively, thereof. In this regard, edges 46 and 48 form fold lines along which side flaps 42 and 44 are folded inwardly so as to be substantially in parallel, spaced relation to center panel 24 in the configuration for mailing which is shown in FIG. 1. Side flaps 42 and 44 have a substantially rectangular configuration, except that one free corner of each flap 42 and 44, which is on the same side of center panel 24 as side panel 36, is cut-out to define a part-circular cut-out 50 and 52, respectively. When side flaps 42 and 44 are folded along edges 46 and 48, in overlying relation to center panel 24, cut-outs 50 and 52 are aligned to form a larger part-circular arc, the reason for which will become apparent from the description which follows.

Side flap 42 further includes two parallel, elongated slits 54 and 56 therein which are angled inwardly toward side panel 34 in the blank configuration of FIG. 2. For example, the angle of inclination can be about 15° relative to the lengthwise direction of mailing pack 20. Alternatively, openings 54 and 56 can be angled inwardly toward side panel 36 in the mailing configuration of FIG. 1. Slits 54 and 56 are displaced from each other in the lengthwise direction of side flap 42, with opening 54 being closer to side panel 34 and opening 56 being closer to side panel 36.

In like manner, side flap 44 further includes two parallel, elongated slits 58 and 60 therein which are angled inwardly toward side panel 34 in the blank configuration of FIG. 2. For example, the angle of inclination can likewise be about 15° relative to the lengthwise direction of mailing pack 20. Alternatively, openings 58 and 60 can be angled inwardly toward side panel 36 in the mailing configuration of FIG. 1. Slit 58 and 60 are displaced from each other in the lengthwise direction of side flap 42, with opening 58 being closer to side panel 34 and opening 60 being closer to side panel 36.

A substantially rectangular lower end flap 62 is hingedly connected to the opposite longer edge 64 of side panel 34, which is opposite edge 26. In this regard, longer edge 64 forms a fold line along which lower end flap 62 is folded so as to be substantially in parallel, spaced relation to center panel 24 in the configuration for mailing which is shown in FIG. 1. In such case, lower end flap 62 is folded over the already folded side flaps 42 and 44, in the configuration for mailing which is shown in FIG. 1.

Figure 3:
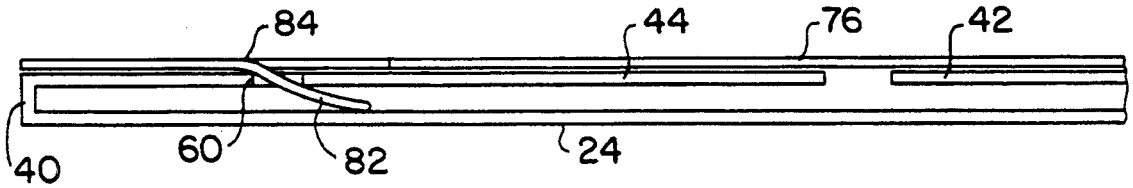
FIG. 3 is a cross-sectional view of the mailing pack of FIG. 1, taken along line 3—3 thereof.

In order to releasably secure lower end flap 62 in this configuration, that is, in overlying relation to side flaps 42 and 44, lower end flap 62 is provided with oppositely facing cut-out thumb tabs 66 and 68 which have a generally trapezoidal configuration, with the larger side 70 of each thumb tab 66 and 68 remaining hingedly connected with the body of lower end flap 62, and the remaining sides being cut away from the body of lower end flap 62. Accordingly, thumb tabs 66 and 68 can be folded about the larger sides 70 thereof, which function as fold lines, out of the plane of lower end flap 62, as best shown in FIGS. 1 and 3. Larger sides 70 of thumb tabs 66 and 68 have the same inclination as slits openings 54 and 58, and larger sides 70 of thumb tabs 66 and 68 are only slightly offset from slits 54 and 58, respectively, when flaps 42, 44 and 62 are in the configuration for mailing which is shown in FIG. 1. Thus, thumb tabs 66 and 68 extend in a direction perpendicular to the direction of slits 54 and 58, and thereby extend in a direction having a large component perpendicular to the lengthwise direction of mailing pack 20. Specifically, on a vector plot, if the lengthwise direction is taken as 0° and the transverse direction as 90°, the direction of inclination or extension of each thumb tab 66 and 68 will have a large transverse or perpendicular component and a smaller component in the lengthwise direction. This is what is meant by a large component perpendicular to the lengthwise direction of mailing pack 20.

It will be appreciated that a stack of papers held in the partial enclosure that is formed can be easily grasped, due to part-circular cut-outs 50 and 52 which form a scoop neck, and can be slidably removed from mailing pack 20 with ease, without disassembling the entire mailing pack 20 into the form of blank 22 shown in FIG. 2.

Lower end flap 62 further includes a cut-out section 72 at the center thereof, starting inwardly from the outer free end edge 74 of lower end flap 62. As shown, cut-out section 72 preferably has the shape of a simple quadrilateral, although the shape is not limited thereby, and any other suitable shape can be used, such as a Christmas tree, a circle and the like.

A substantially rectangular upper end flap 76 is hingedly connected to the opposite longer edge 78 of side panel 36, opposite edge 28. In this regard, longer edge 78 forms a fold line along which upper end flap 76 is folded so as to be substantially in parallel, spaced relation to center panel 24 and adjacent to lower end flap 62, in the configuration for mailing which is shown in FIG. 1. In such case, upper end flap 76 is folded over the already folded side flaps 42 and 44. Throughout the present application, reference to the lengthwise direction of the mailing pack will refer to the direction extending between the end flaps.

In order to releasably secure upper end flap 76 in this configuration, that is, in overlying relation to side flaps 42 and 44, upper end flap 76 is provided with oppositely facing cut-out thumb tabs 80 and 82 which have a generally trapezoidal configuration, with the larger side 84 of each thumb tab 80 and 82 remaining hingedly connected with the body of upper end flap 76, and the remaining sides being cut away from the body of upper end flap 76. Accordingly, thumb tabs 80 and 82 can be folded about the larger sides 84 thereof, which function as fold lines, out of the plane of upper end flap 76, as best shown in FIGS. 1 and 3. Larger sides 84 of thumb tabs 80 and 82 have the same inclination as slit 56 and 60, and larger sides 84 of thumb tabs 80 and 82 are only slightly offset from slit 56 and 60, when flaps 42, 44 and 76 are in the configuration for mailing which is shown in FIG. 1. Thus, thumb tabs 80 and 82 extend in a direction perpendicular to the direction of slit 56 and 60, and thereby extend in a direction having a large component perpendicular to the lengthwise direction of mailing pack 20.

Upper end flap 76 further includes an interlocking tab 86 at the center thereof, extending outwardly from the outer free end edge 88 of upper end flap 76. As shown, interlocking tab 86 preferably has the shape of the same simple quadrilateral of cut-out section 72, although the shape is not limited thereby, and any other suitable shape can be used. In any event, interlocking tab 86 has the same general dimensions and shape as cut-out section 72. In this manner, interlocking tab 86 can removably fit within cut-out section 72 in a similar manner to puzzle pieces, to provide further securement of mailing pack 20 in the mailing configuration of FIG. 1.

Figure 4:
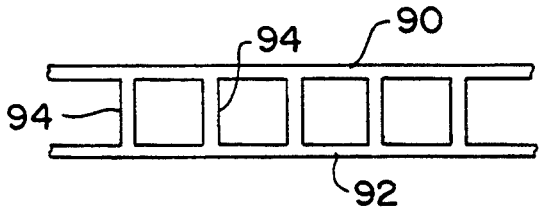
FIG. 4 is a cross-sectional view of the blank of FIG. 2, taken along line 4—4 thereof.

Preferably, blank 22 is made from a corrugated fluted plastic material, which is best shown in the cross-section of FIG. 4. Such corrugated fluted plastic material is formed with two parallel, spaced apart plastic layers 90 and 92, and a plurality of uniformly spaced apart transverse webs 94 extending therebetween and connecting layers 90 and 92 together. Preferably, as shown by dashed lines in FIG. 2, webs 94 extend in the same direction throughout the entire blank 22. Such material is extremely durable for mailing, and is effectively tear-proof, water-repellent, washable and fire retardant. Also, such material enhances the securement by the interlocking tab arrangement. As clearly shown in FIG. 2, tabs 66, 68, 82 and 84 extend substantially in the same direction of the flutes or webs 94 of the corrugated fluted plastic material.

It is preferred that the thickness of blank 22, and thereby of the corrugated fluted plastic material, be substantially uniform throughout in the range of about 2 mm to about 4 mm, with a preferred thickness of about 2.5 mm or 3 mm.

Because thumb tabs 66, 68, 80 and 82 are oriented in a direction having a large component perpendicular to the lengthwise direction of mailing pack 20, and because thumb tabs 66, 68, 80 and 82 extend through slits 54, 58, 56 and 60, respectively, of side flaps 42 and 44 (which are oriented perpendicular to end flaps 62 and 76 containing the thumb tabs), the possibility of accidental dislodgement and removal of thumb tabs 66, 68, 80 and 82 from slits 54, 58, 56 and 60, respectively, is decreased, thereby providing a more secure package for mailing. Further, the use of cut-out section 72 and interlocking tab 86 provides an additional feature against dislodgement and removal of thumb tabs 66, 68, 80, 82, although the primary feature of securement results from thumb tabs 66, 68, 80, 82, and accordingly, cut-out section 72 and interlocking tab 86 can be eliminated if desired. These features thereby provide a secure package for mailing, while also permitting easy assembly, without the need for additional assembly tools such as staples, adhesive, tape or the like. Further, because of the use of the corrugated fluted plastic material, the interlocking nature of interlocking tab 86 with cut-out section 72 is further enhanced, in order to prevent accidental disengagement therebetween.

In addition to the security of mailing pack 20, as discussed above, it will be appreciated that thumb tabs 66, 68, 80 and 82 perform a second function, namely, of pressing down the stack of papers within mailing pack 20, against center panel 24. This is best shown in FIG. 3. This is because of the use of the corrugated fluted plastic material, which has some rigidity, along with the orientation of thumb tabs 66, 68, 80 and 82 relative to slits 54, 58, 56 and 60, respectively, as aforementioned. Accordingly, the stack of papers is held together and is effectively prevented from sliding in mailing pack 20.

It will be appreciated that, with the aforementioned construction, a mailing label can be adhered to the outwardly facing surface of center panel 24. Alternatively, artwork or writings in the form of silk screens or the like can be placed on this surface. In such case, in order not to disturb the artwork or writings, the mailing label can be placed on the opposite surface of mailing pack 20, for example, over cut-out section 72 and interlocking tab 86, thereby providing evidence if tampering has occurred and also providing greater assurance that mailing pack 20 will remain in the mailing configuration of FIG. 1.

Thus, the mailing pack 20 can be given away by vendors, for example, at a trade show, with advertisements thereon. A person then accumulates different literature during the trade show and inserts the same in mailing pack 20. At any time, the person merely closes and secures mailing pack 20 by means of thumb tabs 66, 68, 80 and 82, and interlocking tab 86, and mails the same to his home office. The person can then continue at the trade show or travel to another destination without worrying about the extra weight and bulk from the collected materials.

Further, mailing pack 20 can be used as a point of sale item to be hung from a pegboard or the like. In this manner, center panel 24 can be provided with a rectangular hanging tab 91 which is formed, for example, with a hinged side 93 thereof integral with edge 28, as shown in FIG. 2. The remainder of hanging tab 91 is formed as part of center panel 24 and can be separated therefrom by perforations 95 or the like, so as to be bent outwardly as shown in FIG. 1. A pop-out circular portion 97 is formed in hanging tab 91, and when punched out by a user, creates a hanging hole 99 by which hanging tab 91, and thereby, mailing pack 20 can be hung from a pegboard or the like. It will be appreciated that hanging tab 91 can alternatively be provided on either end flap 62 or 76.

Figure 5:
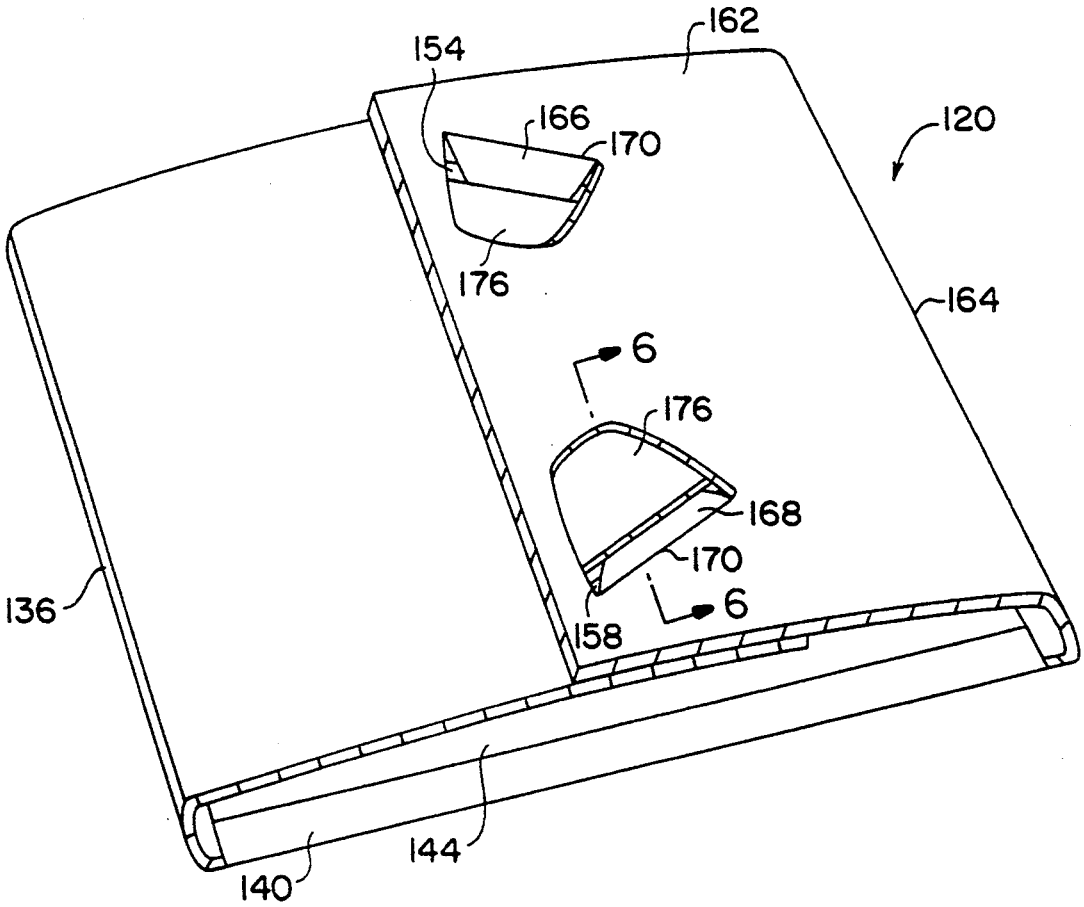
FIG. 5 is a perspective view of a mailing pack according to another embodiment of the present invention.
Figure 6:
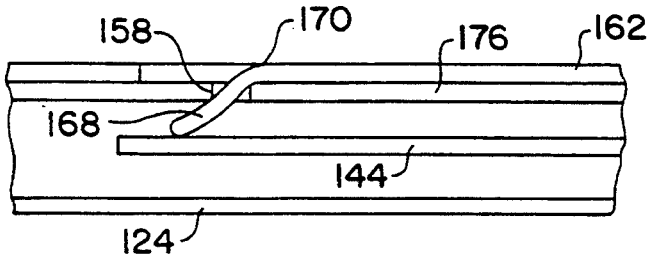
FIG. 6 is a cross-sectional view of the mailing pack of FIG. 5, taken along line 6—6 thereof.
Figure 7:
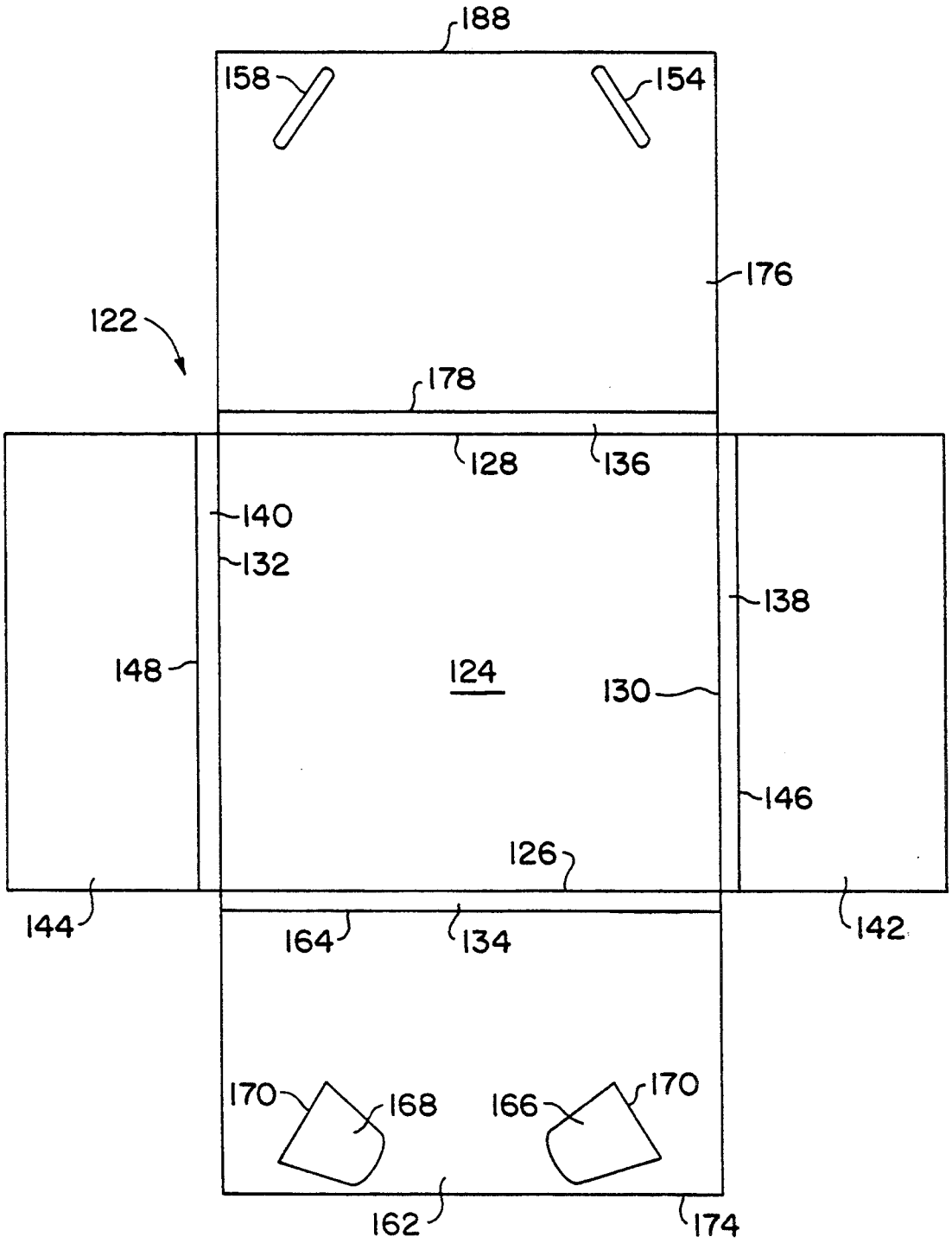
FIG. 7 is a plan view of a blank for forming the mailing pack of FIG. 5.

Referring now to FIGS. 5–7, a mailing pack 120 according to another embodiment of the present invention, which is in the form of a floppy disk mailer, will now be described in which elements corresponding to elements of mailing pack 20 of FIGS. 1–4 are identified by the same reference numerals, augmented by 100, and a description of the common elements will be omitted for the sake of brevity, although it is intended that the remarks made with regard to the elements in FIGS. 1–4 apply equally to the common elements in FIGS. 5–7.

Mailing pack 120 is ideally suited for mailing a conventional $5\frac{1}{4}$ inch floppy disk. Unlike mailing pack 20, mailing pack 120 does not have any slits in side flaps 142 and 144 thereof.

Rather, end flap 176 includes two elongated slits 154 and 158 therein which are angled in a converging manner in a direction away from side panel 136. For example, the angle of inclination can be about 30° from the lengthwise direction of mailing pack 120. Alternatively, openings 154 and 158 can be angled with an opposite inclination, that is, in a diverging manner. Slits 154 and 158 are displaced from each other in the widthwise direction of mailing pack 120, with opening 154 being closer to side flap 144 and opening 158 being closer to side flap 142. It will be appreciated that end flap 176 does not include any cut-out thumb tabs or an interlocking tab.

End flap 162 is provided with oppositely facing cut-out thumb tabs 166 and 168 which have a generally trapezoidal configuration, with the larger side 170 of each thumb tab 166 and 168 remaining hingedly connected with the body of end flap 162, and the remaining sides being cut away from the body of end flap 162. Accordingly, thumb tabs 166 and 168 can be folded about the larger sides 170 thereof, which function as fold lines, out of the plane of end flap 162, as best shown in FIGS. 5 and 6. Larger sides 170 of thumb tabs 166 and 168 have the same inclination as slits 154 and 158, and larger sides 170 of thumb tabs 166 and 168 are only slightly offset from slits 154 and 158, when flaps 42, 44, 62 and 76 are in the configuration for mailing which is shown in FIG. 5. Thus, thumb tabs 166 and 168 extend in a direction perpendicular to the direction of slit-like openings 154 and 158, and thereby extend in a direction having a large component perpendicular to the lengthwise direction of mailing pack 20.

Therefore, unlike mailing pack 20 of FIGS. 1–4, with mailing pack 120, side flaps 142 and 144 do not play a role in securing mailing pack 120 in the mailing configuration of FIG. 5. However, because thumb tabs 166 and 168 are oriented in a direction having a large component perpendicular to the lengthwise direction of mailing pack 120, and because thumb tabs 166 and 168 extend through slits 154 and 158 of end flap 176, the possibility of accidental dislodgement and removal of thumb tabs 166 and 168 from slits 154 and 158, respectively, is decreased, thereby providing a more secure package for mailing.

In addition, with mailing pack 120, it will be appreciated that thumb tabs 166 and 168 do not press down directly on the contents held therein. This is shown best in FIG. 6. This is because side flaps 142 and 144 are interposed between the contents held within mailing pack 120 and thumb tabs 166 and 168. As a result, thumb tabs 166 and 168 press down side flaps 142 and 144 onto the contents held within mailing pack 120 in order to hold the same in place. This is preferable when dealing with floppy disks, since it is better to obtain a pressure contact uniformly over the entire surface, rather than effective point or line contacts over a smaller surface that would otherwise occur if thumb tabs 166 and 168 directly contacted the floppy disk.

Of course, if desired, mailing pack 120 could also utilize an interlocking tab in end flap 176 and a corresponding cut-out section in end flap 162.

Figure 8:
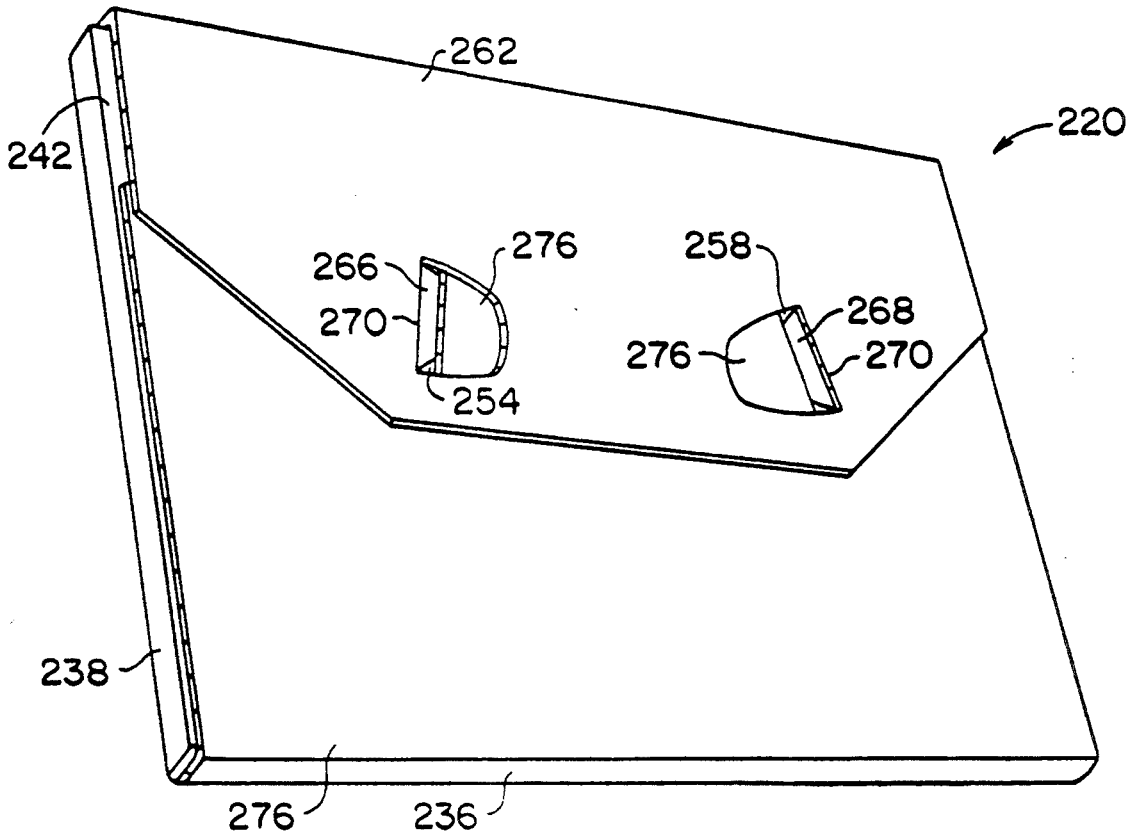
FIG. 8 is a perspective view of a mailing pack according to still another embodiment of the present invention.
Figure 9:
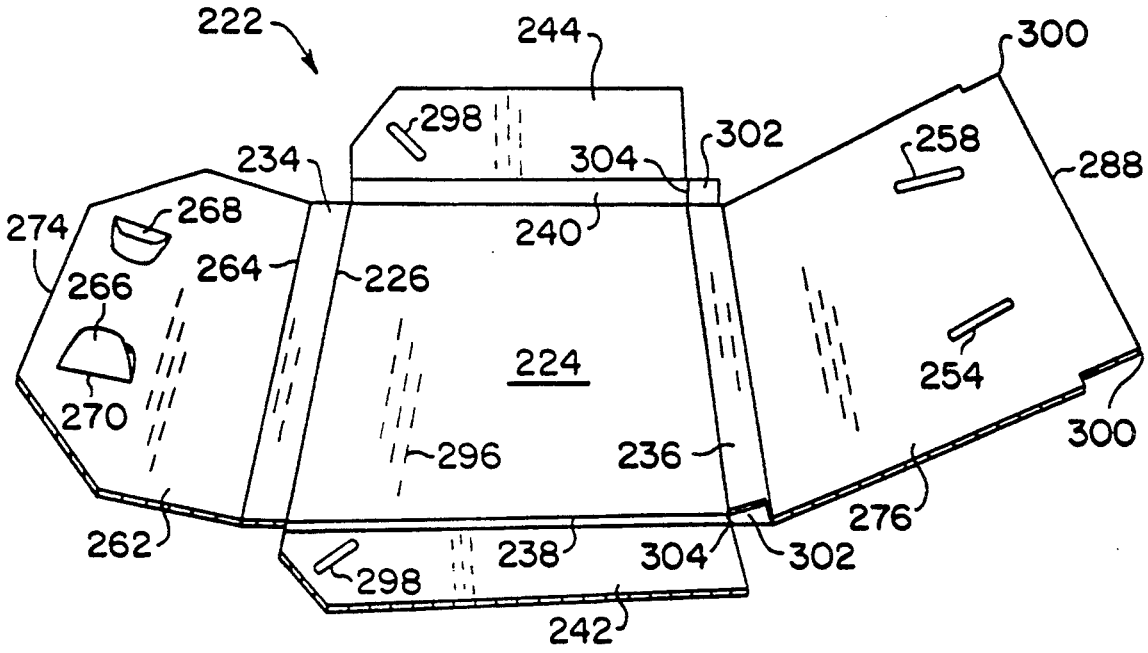
FIG. 9 is a perspective view of a blank for forming the mailing pack of FIG. 8.
Figure 10:
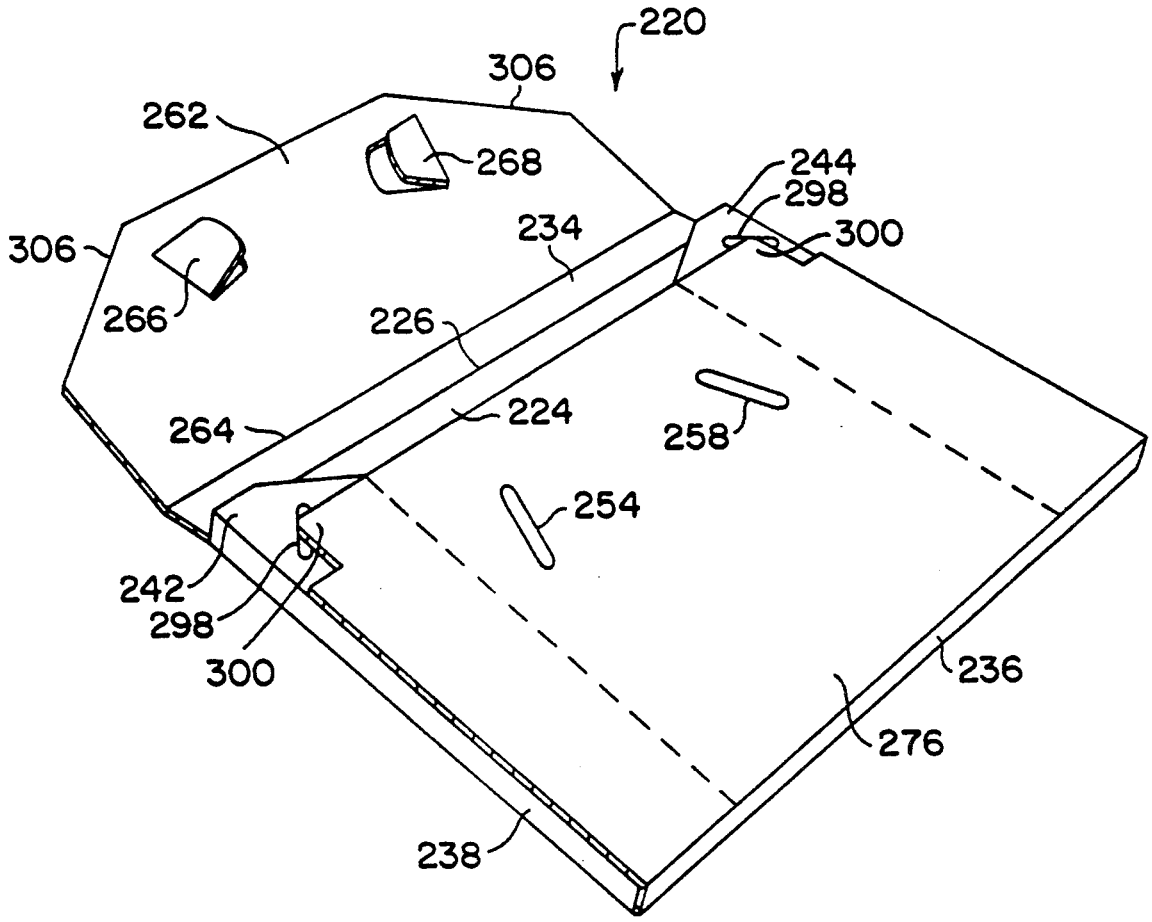
FIG. 10 is a perspective view showing the mailing pack of FIG. 8 in a partially opened configuration.

Referring now to FIGS. 8–10, a mailing pack 220 according to another embodiment of the present invention, which is in the form of a mail pouch, will now be described in which elements corresponding to elements of mailing pack 120 of FIGS. 5–7 are identified by the same reference numerals, augmented by 100, and a description of the common elements will be omitted for the sake of brevity, although it is intended that the remarks made with regard to the elements in each of the embodiments of FIGS. 1–4 and FIGS. 5–7 apply equally to the common elements in FIGS. 8–10. Mailing pack 220 is ideally suited for performing in a dual capacity, that is, operating as a conventional file folder and for mailing documents.

With mailing pack 220, end flap 276 has larger dimensions than end flap 262 in the lengthwise direction of mailing pack 220, with end flap 276 extending almost to folding edge 226, as shown best in FIG. 10. Each side flap 242 and 244 includes an angled slits 298 adjacent the end thereof closest to side panel 234, with openings 298 converging in a direction toward side panel 234 in the partially assembled condition of FIG. 10. In such condition, as shown in FIG. 10, the corners 300 at outer free end edge 288 of end flap 276 slip within slit 298 in order to hold lower end flap 276 in the assembled condition with side flaps 242 and 244. Because lower end flap 276 has a lesser length than side flaps 242 and 244, there is an open portion adjacent to folding edge 226, which forms a scoop neck and thereby has a similar function to the larger part-circular arc of mailing pack 20 of FIGS. 1–4 that is formed from cut-outs 50 and 52. In the manner, documents can be easily inserted into and removed from mailing pack 220. It will be appreciated that any other suitable means can be used for securing end flap 276 to side flaps 242 and 244, such as cut-out thumb tabs or the like.

The remainder of mailing pack 220 is substantially identical in form to mailing pack 120, with minor exceptions as to dimensions, angles and the like. For example, a bent tab 302 is hingedly connected to the lower edge of each side flap 242 and 244, along a respective fold line 304, for better sealing of the lower end of mailing pack 220 and for improved strength. In addition, instead of opposite sharp corners for outer free end edge 274, there are beveled edges 306 to better impart the appearance of an attache case or the like.

Further, it will be appreciated that side flaps 242 and 244 are relatively narrow so that cut-out thumb tabs 266 and 268, when inserted within slits 254 and 258, operate to directly press the documents held within mailing pack 220, in the same manner as the cut-out thumb tabs of mailing pack 20 of FIGS. 1–4.

It will be appreciated that various orientations have been discussed above with respect to the slits and cut-out thumb tabs. In accordance with the present invention, the orientation of each cut-out thumb tab has a large component which is perpendicular to the lengthwise direction of the mailing pack, that is, in which the direction of orientation of the cut-out thumb tabs is greater than about 45°, and preferably greater than about 60°.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A mailing pack comprising:

a bottom panel;

first and second side flaps hingedly connected with first and second opposite edges of said bottom panel;

first and second end flaps hingedly connected along hinge edges thereof with third and fourth opposite edges of said bottom panel, between said first and second opposite edges, said first end flap extending in a first direction from the hinge edge thereof and forming an outer surface of said mailing pack;

said bottom panel, said first an second side flaps and said first and second end flaps being constructed from a fluted material having flutes extending in a second direction; and securing means for securing said first and second end flaps in substantially parallel covering relation to said first and second side flaps and said bottom panel, said securing means including:

at least one slit in one of the following:

said side flaps, and said second end flap; and tab means hingedly connected with said first end flap for slidable engagement within said at least one slit, said tab means being cut-out from said first end flap at a position spaced inwardly from edges of said first end flap, and said tab means extending substantially in said second direction of said flutes and in a direction different from said first direction of said first end flap.

2. A mailing pack according to claim 1, wherein said tab means on said first end flap includes two tabs which substantially face each other.

3. A mailing pack according to claim 1, wherein each said tab includes a long edge hingedly connected with said first end flap, an opposite free shorter edge and side edges which connect said long edge and said shorter edge.

4. A mailing pack according to claim 1, wherein said at least one slits includes at least one slit formed in said first side flap and at least one slit formed in said second side flap.

5. A mailing pack according to claim 4, wherein there are two said slits in each said side flap, the slits in said first side flap being substantially parallel to each other and spaced apart in said lengthwise direction and the slits in said second side flap being substantially parallel to each other and spaced apart in said lengthwise direction.

6. A mailing pack according to claim 1, wherein said second end flap extends in a direction opposite from said first direction from the hinge edge thereof, and further including second tab means hingedly connected with said second end flap for slidable engagement within said at least one slit, said second tab means being cut-out from said second end flap at a position spaced inwardly from edges of said second end flap, and said second tab means extending substantially in said second direction of said flutes and in a direction different from said opposite direction of said second end flap.

7. A mailing pack according to claim 6, wherein said tab means on said second end flap includes two tabs which substantially face each other.

8. A mailing pack according to claim 1, further including:

first side wall means for hingedly connecting said first side flap to said bottom panel;

second side wall means for hingedly connecting said second side flap to said bottom panel;

first end wall means for hingedly connecting said first end flap to said bottom panel; and second end wall means for hingedly connecting said second end flap to said bottom panel.

9. A mailing pack according to claim 8, wherein said mailing pack has a height determined by said first and second side wall means and said first and second end wall means, and wherein each of said first and second side wall means and said first and second end wall means have a plurality of score line means along which said first and second side wall means and said first and second end wall means can be bent, for changing the height of said mailing pack.

10. A mailing pack according to claim 1, wherein said bottom panel, said first and second side flaps and said first and second end flaps are constructed from a corrugated fluted plastic material.

11. A mailing pack according to claim 1, wherein said at least one slit includes first and second slits formed in said second end flap.

12. A mailing pack according to claim 11, wherein said first and second slits are oriented at substantially equal and opposite angles relative to said lengthwise direction.

13. A mailing pack according to claim 1, further including hanging tab means formed as part of at least one of said bottom panel, said first end flap and said second end flap.

14. A mailing pack comprising:

a bottom panel;

first and second side flaps hingedly connected with first and second opposite edges of said bottom panel;

first and second side flaps hingedly connected with third and fourth opposite edges of said bottom panel, between said first and second opposite edges, a lengthwise direction of said mailing pack being defined as extending between said first and second end flaps, and said first and second end flaps being foldable in said lengthwise direction; and securing means for securing said first and second end flaps in substantially parallel covering relation to said first and second side flaps and said bottom panel, said securing means including:

at least one slit in one of the following:

said side flaps, and said second end flap;

tab means hingedly connected with said first end flap for slidable engagement within said at least one slit, said tab means extending and being foldable in a direction having a large component perpendicular to said lengthwise direction; and tab means hingedly connected with said second end flap for slidable engagement within said at least one slit, said tab means extending in a direction having a large component perpendicular to said lengthwise direction, said tab means on said second end flap including at least one tab connected with said second end flap, each said tab including a long edge hingedly connected with said second end flap, an opposite free shorter edge and side edges which connect said long edge and said shorter edge, and each tab extending in a direction having a large component perpendicular to said lengthwise direction.

15. A mailing pack comprising:

a bottom panel;

first and second side flaps hingedly connected with first and second opposite edges of said bottom panel;

first and second end flaps hingedly connected with third and fourth opposite edges of said bottom panel, between said first and second opposite edges, a lengthwise direction of said mailing pack being defined as extending between said first and second end flaps, and said first and second end flaps being foldable in said lengthwise direction, said first and second end flaps each including an outer free edge;

securing means for securing said first and second end flaps in substantially parallel covering relation to said first and second side flaps and said bottom panel, said securing means including:

at least one slit in one of the following:

said side flaps, and said second end flap;

tab means hingedly connected with said first end flap for slidable engagement within said at least one slit, said tab means extending and being foldable in a direction having a large component perpendicular to said lengthwise direction;

a cut-out section in one of said first and second end flaps, said cut-out section extending inwardly from the outer free edge of said one of said first and second end flaps; and interlocking tab means for lockingly engaging within said cut-out section, said interlocking tab means extending from the outer free edge of the other of said first and second end flaps, said interlocking tab means having substantially identical dimensions and shape to said cut-out section for engaging therein when said first and second end flaps are folded over and are substantially parallel to said bottom panel.

16. A mailing pack according to claim 15, wherein said interlocking tab means has a shape of a simple quadrilateral.

17. A mailing pack comprising:

a bottom panel;

first and second side flaps hingedly connected with first and second opposite edges of said bottom panel;

first and second end flaps hingedly connected with third and fourth opposite edges of said bottom panel, between said first and second opposite edges, a lengthwise direction of said mailing pack being defined as extending between said first and second end flaps, and said first and second end flaps being foldable in said lengthwise direction;

securing means for securing said first and second end flaps in substantially parallel covering relation to said first and second side flaps and said bottom panel, said securing means including:

at least one slit in one of the following:

said side flaps, and said second end flap;

said at least one slit including first and second slits formed in said second end flap, said first and second slits being oriented at substantially equal and opposite angles relative to said lengthwise direction;

tab means hingedly connected with said first end flap for slidable engagement within said at least one slit, said tab means extending and being foldable in a direction having a large component perpendicular to said lengthwise direction; and slit means in each of said side flaps for receiving at least one free corner of said second end flap.

18. A mailing pack comprising:

a bottom panel;

first and second side flaps hingedly connected with first and second opposite edges of said bottom panel;

first and second end flaps hingedly connected along hinge edges thereof with third and fourth opposite edges of said bottom panel, between said first and second opposite edges, said first end flap extending in a first direction from the hinge edge thereof and said second end flap extending in a direction opposite from said first direction from the hinge edge thereof, and said first and second end flaps forming outer surfaces of said mailing pack;

said bottom panel, said first and second side flaps and said first and second end flaps being constructed from a fluted material having flutes extending in a second direction; and securing means for securing said first and second end flaps in substantially parallel covering relation to said first and second side flaps and said bottom panel, said securing means including:

first and second slits in each of said side flaps, first and second tab means hingedly connected with said first end flap for slidable engagement within said first slits of said first and second side flaps, each of said first and second tab means being cut-out from said first end flap at positions spaced inwardly from edges of said first end flap, said first and second tab means extending substantially in said second direction and in a direction different from said first direction of said first end flap, and third and fourth tab means hingedly connected with said second end flap for slidable engagement within said second slits of said first and second side flaps, each of said third and fourth tab means being cut-out from said second end flap at positions spaced inwardly from edges of said second end flap, said third and fourth tab means extending substantially in said second direction of said flutes and in a direction different from said opposite direction of said second flap.

19. A mailing pack according to claim 18, wherein said first and second end flaps each include an outer free edge, and further including:

a cut-out section in one of said first and second end flaps, said cut-out section extending inwardly from the outer free edge of said one of said first and second end flaps, and interlocking tab means for lockingly engaging within said cut-out section, said interlocking tab means extending from the outer free edge of the other of said first and second end flaps, said interlocking tab means having substantially identical dimensions and shape to said cut-out section for engaging therein when said first and second end flaps are folded over and are substantially parallel to said bottom panel.

20. A mailing pack according to claim 18, further including slit means in each of said side flaps for receiving at least one free corner of said second end flap.

21. A mailing pack comprising:

a bottom panel;

first and second side flaps hingedly connected with first and second opposite edges of said bottom panel;

first and second end flaps hingedly connected along hinge edges thereof with third and fourth opposite edges of said bottom panel, between said first and second opposite edges, said first end flap extending in a first direction from the hinge edge thereof and forming an outer surface of said mailing pack;

said bottom panel, said first and second side flaps and said first and second end flaps being constructed from a fluted material having flutes extending in a second direction; and securing means for securing said first and second end flaps in substantially parallel covering relation to said first and second side flaps and said bottom panel, said securing means including:

first and second slits in said second end flap, first and second tab means hingedly connected with said first end flap for slidable engagement within said first and second slits, said first and second tab means being cut-out from said first end flap at a position spaced inwardly from edges of said first end flap, and said first and second tab means extending substantially in said second direction of said flutes and in a direction different from said first direction of said first end flap.

* * * * *

UNITED STATES PATENT AND TRADEMARK OFFICE

CERTIFICATE OF CORRECTION

PATENT NO. : 5,364,021

DATED : NOVEMBER 15, 1994

INVENTOR(S) : Marvin R. Munk

It is certified that error appears in the above-indentified patent and that said Letters Patent is hereby corrected as shown below:

Column 10, line 29, change "slits" to --slit--.

Column 11, line 24, change "side" to --end--.

Signed and Sealed this

Twenty-fourth Day of January, 1995

*Attest:*

*Attesting Officer*

BRUCE LEHMAN

*Commissioner of Patents and Trademarks*